US009240273B2

(12) United States Patent
Hashimoto

(10) Patent No.: US 9,240,273 B2
(45) Date of Patent: Jan. 19, 2016

(54) ELECTRONIC COMPONENT AND METHOD FOR PRODUCING SAME

(71) Applicant: MURATA MANUFACTURING CO., LTD., Kyoto (JP)

(72) Inventor: Hiroki Hashimoto, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 56 days.

(21) Appl. No.: 14/087,754

(22) Filed: Nov. 22, 2013

(65) Prior Publication Data

US 2014/0077917 A1 Mar. 20, 2014

Related U.S. Application Data

(63) Continuation of application No. PCT/JP2012/069987, filed on Aug. 6, 2012.

(30) Foreign Application Priority Data

Oct. 13, 2011 (JP) ..... 2011-225775

(51) Int. Cl.
*H01F 5/00* (2006.01)
*H01F 27/28* (2006.01)
*H01F 17/00* (2006.01)

(52) U.S. Cl.
CPC ..... *H01F 27/2804* (2013.01); *H01F 17/0013* (2013.01); *H01F 2017/004* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

2004/0252596 A1* 12/2004 Cho et al. ..... 369/44.12
2009/0243784 A1* 10/2009 Iwasaki ..... 336/200
2009/0256668 A1* 10/2009 Noma et al. ..... 336/200

FOREIGN PATENT DOCUMENTS

CN 101578670 A 11/2009
CN 101589444 A 11/2009
JP 06-120065 A 4/1994
JP 10-303027 A 11/1998

(Continued)

OTHER PUBLICATIONS

International Search Report; PCT/JP2012/069987; Sep. 4, 2012.

(Continued)

*Primary Examiner* — Tsz Chan
(74) *Attorney, Agent, or Firm* — Studebaker & Brackett PC

(57) ABSTRACT

An electronic component having a laminate formed by laminating a plurality of insulator layers and a helical coil provided in the laminate, the coil including first and second coil conductors, and via-hole conductors provided so as to pierce through the insulator layers. The first and second coil conductors are opposed to each other via the insulator layers in a direction of lamination. The first coil conductor has a first side opposed to the second coil conductor and having a convex portion in a cross section normal to a direction in which the first coil conductor extends. The second coil conductor has a second side opposed to the first coil conductor and has a concave portion in a cross section normal to a direction in which the second coil conductor extends. The concave portion overlaps the convex portion in the direction of lamination.

7 Claims, 7 Drawing Sheets

(56) References Cited

FOREIGN PATENT DOCUMENTS

| | | | | |
|---|---|---|---|---|
| JP | 2000-021636 | A | | 1/2000 |
| JP | 2001-176725 | A | | 6/2001 |
| JP | 2002334813 | A | * | 11/2002 |
| JP | 2004-080023 | A | | 3/2004 |
| JP | 2007-123726 | A | | 5/2007 |
| WO | 2008/090852 | A1 | | 7/2008 |
| WO | 2009/081865 | A1 | | 7/2009 |

OTHER PUBLICATIONS

Written Opinion of the International Searching Authority; PCT/JP2012/069987; Sep. 4, 2012.

Japanese Office Action; "Notification of Reasons for Refusal"; JP2013-538464; Nov. 12, 2013.

An Office Action; "Notice of Reasons for Refusal," issued by the Japanese Patent Office on May 20, 2014, which corresponds to Japanese Patent Application No. 2013-538464 and is related to U.S. Appl. No. 14/087,754; with English language translation.

* cited by examiner

ELECTRONIC COMPONENT AND METHOD FOR PRODUCING SAME

CROSS REFERENCE TO RELATED APPLICATIONS

This application claims benefit of priority to Japanese Patent Application No. 2011-225775 filed on Oct. 13, 2011, and to International Patent Application No. PCT/JP2012/069987 filed on Aug. 6, 2012, the entire content of each of which is incorporated herein by reference.

TECHNICAL FIELD

The technical field relates to electronic components and methods for producing the same, more particularly to an electronic component including a helical coil and a method for producing the same.

BACKGROUND

As a conventional electronic component, a laminated electronic component described in, for example, Japanese Patent Laid-Open Publication No. 2001-176725 is known. FIG. 8 is a cross-sectional structural view of a laminate 500 of the laminated electronic component described in Japanese Patent Laid-Open Publication No. 2001-176725.

The laminated electronic component includes the laminate 500 and a coil 502. The laminate 500 is formed by laminating a plurality of ceramic green sheets 504. The coil 502 is provided in the laminate 500, and is formed by connecting coil conductors 506 and through-hole conductors V in series. The coil conductors 506 are formed on the ceramic green sheets 504, and have rectangular cross sections.

Incidentally, the laminated electronic component described in Japanese Patent Laid-Open Publication No. 2001-176725 has a problem in that the coil conductors 506 are prone to lamination misalignment. More specifically, in the laminated electronic component, the coil conductors 506 are stacked in the direction of lamination, as shown in FIG. 8. Accordingly, in the laminate 500, the height of the area where the coil conductor 506 is formed in the direction of lamination is greater than the height of the area where no coil conductor 506 is formed. Therefore, when the laminate 500 is subjected to pressure bonding, an applied force is concentrated on the areas where the coil conductors 506 are formed. As a result, the coil conductors 506 might be misaligned in directions perpendicular to the direction of lamination.

SUMMARY

The present disclosure provides an electronic component and a method for producing the same, capable of reducing occurrence of misalignment of coil conductors.

An electronic component according to a first embodiment of the present disclosure includes: a laminate formed by laminating a plurality of insulator layers; and a helical coil provided in the laminate and formed by a plurality of coil conductors provided on the insulator layers, including first and second coil conductors, and via-hole conductors provided so as to pierce through the insulator layers, wherein the first and second coil conductors are opposed to each other via the insulator layer in a direction of lamination, the first coil conductor has a first side opposed to the second coil conductor and having a convex portion in a cross section normal to a direction in which the first coil conductor extends, and the second coil conductor has a second side opposed to the first coil conductor and having a concave portion in a cross section normal to a direction in which the second coil conductor extends, the concave portion overlapping the convex portion in the direction of lamination.

An electronic component according to a second embodiment of the present disclosure includes: a laminate formed by laminating a plurality of insulator layers; and a helical coil provided in the laminate and formed by a plurality of coil conductors provided on the insulator layers, including first and second coil conductors, and via-hole conductors provided so as to pierce through the insulator layers, wherein the first and second coil conductors are opposed to each other via the insulator layer in a direction of lamination, the first coil conductor has a first side opposed to the second coil conductor and having a convex portion in a cross section normal to a direction in which the first coil conductor extends, and the second coil conductor is divided into a plurality of parts arranged in its width direction in a cross section normal to a direction in which the second coil conductor extends, such that the second coil conductor does not overlap the convex portion in the direction of lamination.

An electronic component according to a third embodiment of the present disclosure includes: a laminate formed by laminating a plurality of insulator layers; and a helical coil provided in the laminate and formed by a plurality of coil conductors provided on the insulator layers, including first and second coil conductors, and via-hole conductors provided so as to pierce through the insulator layers, wherein the first and second coil conductors are arranged in a direction of lamination, the first coil conductor is divided into a plurality of parts arranged in its width direction in a cross section normal to a direction in which the first coil conductor extends, and the second coil conductor is divided into a plurality of parts arranged in its width direction in a cross section normal to a direction in which the second coil conductor extends, such that the second coil conductor does not overlap the first coil conductor in the direction of lamination.

A fourth embodiment of the present disclosure is directed to a method for producing an electronic component including a laminate formed by laminating a plurality of insulator layers, and a helical coil provided in the laminate and formed by a plurality of coil conductors provided on the insulator layers, including first and second coil conductors, and via-hole conductors provided so as to pierce through the insulator layers, the method including the steps of: forming the first coil conductor on the insulator layer; forming the second coil conductor on the insulator layer; and laminating the insulator layers such that the first and second coil conductors are opposed to each other via the insulator layer, wherein in the step of forming the first coil conductor, the first coil conductor is formed using a first mask pattern provided with a first number of openings in a cross section normal to a direction in which the first coil conductor extends, and in the step of forming the second coil conductor, the second coil conductor is formed using a second mask pattern provided with a second number of openings arranged in a width direction of the second coil conductor in a cross section normal to a direction in which the second coil conductor extends, and the first and second numbers differ by 1.

DETAILED DESCRIPTION

Hereinafter, an electronic component according to an embodiment of the present disclosure and a method for producing the same will be described.

Figure 1:
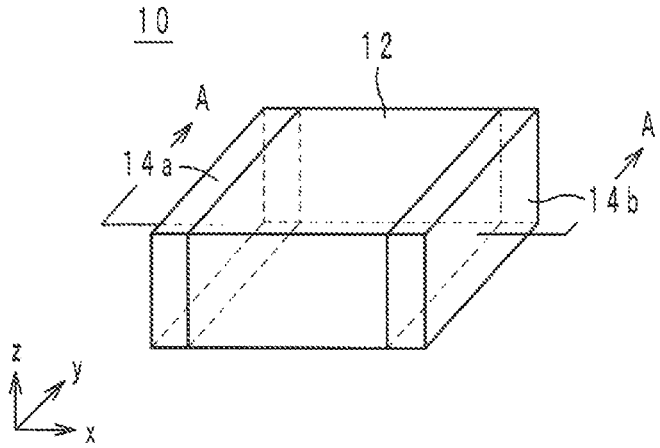
FIG. 1 is an external oblique view of an electronic component according to an exemplary embodiment of the present disclosure.
Figure 2:
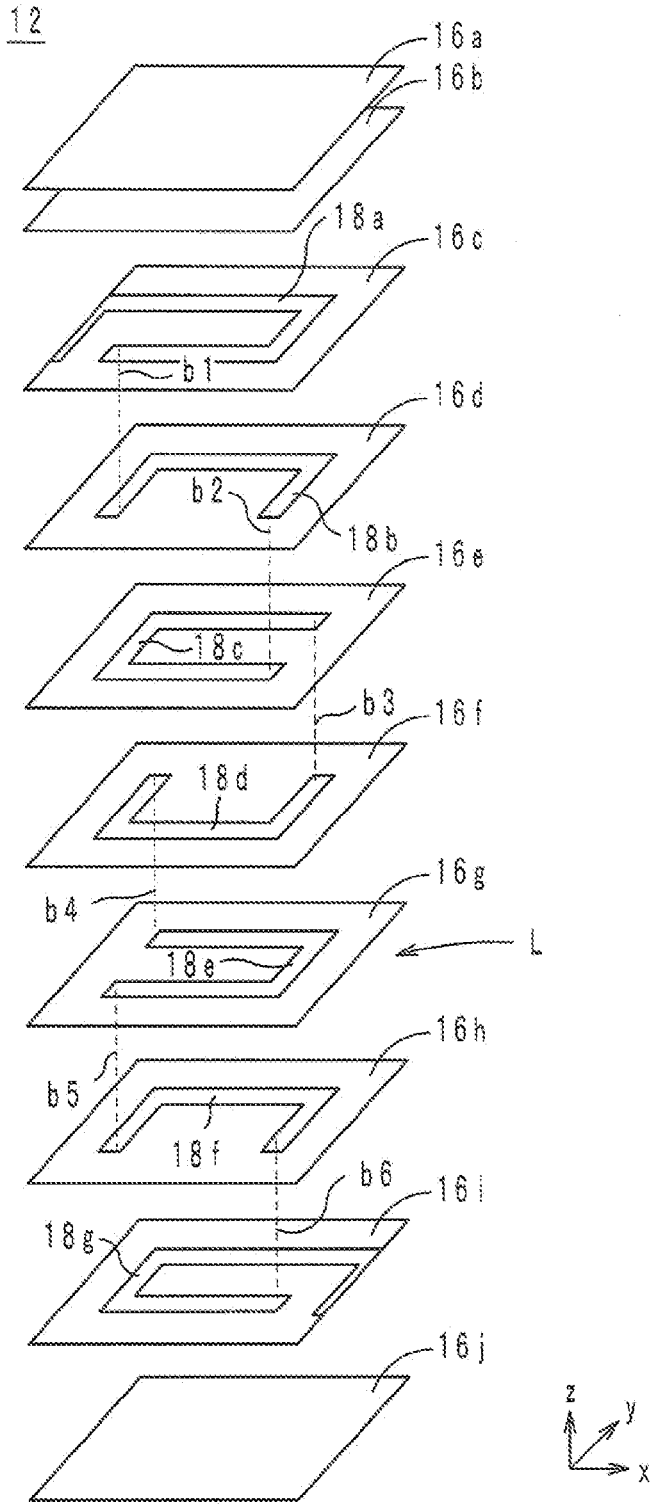
FIG. 2 is an exploded oblique view of a laminate of the electronic component according to the embodiment of FIG. 1.

Configuration of Electronic Component:

The configuration of the electronic component according to one exemplary embodiment of the present disclosure will be described. FIG. 1 is an external oblique view of the electronic component 10 according to the embodiment of the present disclosure. FIG. 2 is an exploded oblique view of a laminate 12 of the electronic component 10 according to the one embodiment. FIG. 3 is a cross-sectional structural view taken along line A-A of FIG. 1.

In the following, the direction of lamination of the electronic component 10 will be defined as a z-axis direction, and the directions along two, long and short, respectively, sides of the top surface of the electronic component 10 on the positive side in the z-axis direction will be defined as an x-axis direction and a y-axis direction, respectively. The x-axis and y-axis directions are perpendicular to the z-axis direction.

The electronic component 10 includes the laminate 12, external electrodes 14 (14*a* and 14*b*), and a coil L, as shown in FIG. 2.

The laminate 12 is in the shape of a rectangular solid, and has the coil L provided therein. In the following, the surface of the laminate 12 on the positive side in the z-axis direction will be defined as the top surface, and the surface of the laminate 12 on the negative side in the z-axis direction will be defined as the bottom surface. Moreover, the other surfaces of the laminate 12 will be defined as the side surfaces.

The laminate 12 is formed by laminating insulator layers 16 (16*a* to 16*j*) in this order, from the positive side to the negative side in the z-axis direction, as shown in FIG. 2. In the following, the surface of the insulator layer 16 on the positive side in the z-axis direction will be referred to as the front face, and the surface of the insulator layer 16 on the negative side in the z-axis direction will be referred to as the back face.

The external electrode 14*a* is provided so as to cover the side surface of the laminate 12 on the negative side in the x-axis direction, as shown in FIG. 1. The external electrode 14*b* is provided so as to cover the side surface of the laminate 12 on the positive side in the x-axis direction, as shown in FIG. 1. Moreover, the external electrodes 14*a* and 14*b* bend toward the top and bottom surfaces of the laminate 12 and also toward the side surfaces of the laminate 12 on the positive and negative sides in the y-axis direction. The external electrodes 14*a* and 14*b* function as connection terminals for electrically connecting the coil L to a circuit external to the electronic component 10.

The coil L is provided in the laminate 12, and consists of coil conductors 18 (18*a* to 18*g*) and via-hole conductors b1 to b6, as shown in FIG. 2. The coil L is in the form of a spiral connecting the coil conductors 18 and the via-hole conductors b1 to b6.

The coil conductors 18*a* to 18*g* are U-shaped linear conductor layers provided on the front faces of the insulator layers 16*c* to 16*i*, as shown in FIG. 2, such that they are arranged spirally clockwise in a plan view from the positive side in the z-axis direction. The coil conductors 18*a* to 18*g* in a plan view in the z-axis direction overlap to form a rectangularly annular trajectory. More specifically, the coil conductors 18*a* to 18*g* make three quarters of a turn along three sides of their respective insulator layers 16*c* to 16*i*. The coil conductor 18*a* is provided along the three sides of the insulator layer 16*c* other than the short side on the negative side in the x-axis direction. Moreover, the coil conductor 18*a* extends to the short side of the insulator layer 16*c* on the negative side in the x-axis direction, so as to be connected to the external electrode 14*a*. The coil conductor 18*b* is provided along the three sides of the insulator layer 16*d* other than the long side on the negative side in the y-axis direction. The coil conductor 18*c* is provided along the three sides of the insulator layer 16*e* other than the short side on the positive side in the x-axis direction. The coil conductor 18*d* is provided along the three sides of the insulator layer 16*f* other than the long side on the positive side in the y-axis direction. The coil conductor 18*e* is provided along the three sides of the insulator layer 16*g* other than the short side on the negative side in the x-axis direction. The coil conductor 18*f* is provided along the three sides of the insulator layer 16*h* other than the long side on the negative side in the y-axis direction. The coil conductor 18*g* is provided along the three sides of the insulator layer 16*i* other than the short side on the positive side in the x-axis direction. Moreover, the coil conductor 18*g* extends to the short side of the insulator layer 16*i* on the positive side in the x-axis direction, so as to be connected to the external electrode 14*b*.

In the following, the ends of the coil conductor 18 located upstream and downstream, respectively, in the clockwise direction in a plan view from the positive side in the z-axis direction will be simply referred to as the upstream and downstream ends. Note that the coil conductor 18 consists of but is not limited to three quarters of a turn. Therefore, the coil conductor 18 may consist of seven eighths of a turn.

The via-hole conductors b1 to b6 are provided so as to pierce through the insulator layers 16*c* to 16*h* in the z-axis direction, as shown in FIG. 2. More specifically, the via-hole conductor b1 pierces through the insulator layer 16*c* in the z-axis direction, and connected to the downstream end of the coil conductor 18*a* and the upstream end of the coil conductor 18*b*. The via-hole conductor b2 pierces through the insulator layer 16*d* in the z-axis direction, and connected to the downstream end of the coil conductor 18*b* and the upstream end of the coil conductor 18*c*. The via-hole conductor b3 pierces through the insulator layer 16*e* in the z-axis direction, and connected to the downstream end of the coil conductor 18*c* and the upstream end of the coil conductor 18*d*. The via-hole conductor b4 pierces through the insulator layer 16*f* in the z-axis direction, and connected to the downstream end of the coil conductor 18*d* and the upstream end of the coil conductor 18*e*. The via-hole conductor b5 pierces through the insulator layer 16*g* in the z-axis direction, and connected to the downstream end of the coil conductor 18*e* and the upstream end of the coil conductor 18*f*. The via-hole conductor b6 pierces through the insulator layer 16*h* in the z-axis direction, and connected to the downstream end of the coil conductor 18*f* and the upstream end of the coil conductor 18*g*.

The electronic component 10 has features that inhibit occurrence of lamination misalignment among the coil conductors 18*a* to 18*g*. The features will be described below with reference to FIGS. 3A and 3B, focusing on the coil conductors 18*a* and 18*b*.

The coil conductors 18*a* and 18*b* are opposed to each other in the z-axis direction with respect to the insulator layer 16*c*. In the following, the side of the coil conductor 18*a* that is opposed to the coil conductor 18*b* (i.e., the side being located on the negative side in the z-axis direction) will be defined as the side S1. Moreover, the side of the coil conductor 18*b* that is opposed to the coil conductor 18*a* (i.e., the side being located on the positive side in the z-axis direction) will be defined as the side S2.

The side S1 has a convex portion A1 bulging toward the coil conductor 18*b* (i.e., toward the negative side in the z-axis direction) in a cross section normal to the direction (y-axis direction) in which the coil conductor 18*a* extends. Moreover, the coil conductor 18*a* has curving-down portions A2 and A3 on the positive and negative sides, respectively, in the x-axis direction relative to the convex portion A1 (i.e., on the outside in the width direction of the coil conductor 18*a*). The curving-down portions A2 and A3 are curved in the direction away from the coil conductor 18*b* (toward the positive side in the z-axis direction).

Furthermore, the side S3 of the coil conductor 18*a* that is located on the positive side in the z-axis direction has a shape of the side S1 turned upside down. In this manner, the coil conductor 18*a* is shaped so as to be relatively thick at the center in the width direction (x-axis direction), and relatively thin at both ends in the width direction.

The side S2 has a concave portion A4 recessed in the direction away from the coil conductor 18*a* (toward the negative side in the z-axis direction) in a cross section normal to the direction (y-axis direction) in which the coil conductor 18*b* extends. The concave portion A4 overlaps the convex portion A1 in the z-axis direction. Moreover, the coil conductor 18*b* has projected portions A5 and A6 on the positive and negative sides, respectively, in the x-axis direction relative to the concave portion A4 (i.e., on the outside in the width direction of the coil conductor 18*b*). The projected portions A5 and A6 protrude toward the coil conductor 18*a* (i.e., toward the positive side in the z-axis direction). The projected portions A5 and A6 overlap the curving-down portions A2 and A3, respectively, in the z-axis direction. As a result, the shape of the side S2 conforms with the shape of the side S1.

Furthermore, the side S4 of the coil conductor 18*b* that is located on the negative side in the z-axis direction has a shape of the side S2 turned upside down. In this manner, the coil conductor 18*b* is shaped so as to be relatively thin at the center in the width direction (x-axis direction), and relatively thick at both ends in the width direction.

The coil conductors 18*c*, 18*e*, and 18*g* have the same shape as the coil conductor 18*a*, and the coil conductors 18*d* and 18*f* have the same shape as the coil conductor 18*b*. As a result, the coil conductor 18*a*, and the coil conductors 18*c*, 18*e*, and 18*g*, which have the same shape as the coil conductor 18*a*, alternate with the coil conductor 18*b*, and the coil conductors 18*d* and 18*f*, which have the same shape as the coil conductor 18*b*, in the z-axis direction. Note that the shapes of the coil conductors 18*a* to 18*g* are the same in the cross section perpendicular to line A-A of FIG. 1 as in the cross section taken along line A-A.

Figure 4A:
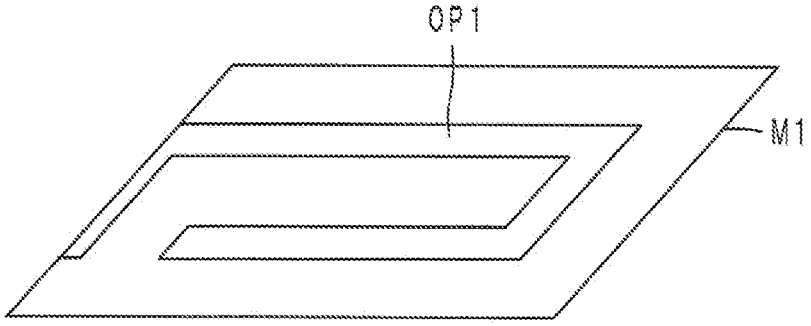
FIG. 4A illustrates a screen plate M1 for use in forming a coil conductor.
Figure 4B:
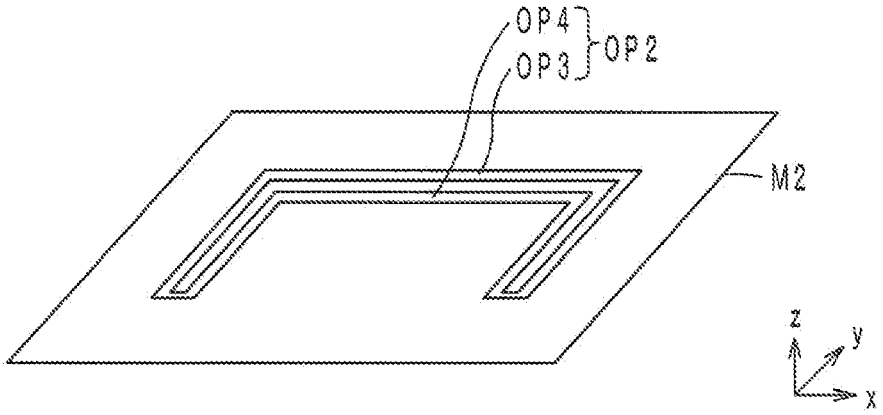
FIG. 4B illustrates a screen plate M2 for use in forming a coil conductor.

Method for Producing Electronic Component:

The method for producing the electronic component 10 will be described below with reference to the drawings. FIG. 4A illustrates a screen plate M1 for use in forming the coil conductor 18*a*, and FIG. 4B illustrates a screen plate M2 for use in forming the coil conductor 18*b*. While the method will be described below concerning production of only one electronic component 10, in actuality, large-sized mother ceramic green sheets are laminated to form a mother laminate, and furthermore, the mother laminate is cut to create a plurality of laminates simultaneously.

Initially, ceramic green sheets from which to make insulator layers 16 are prepared. Specifically, materials weighed at a predetermined ratio, including ferric oxide ($Fe_2O_3$), zinc oxide (ZnO), nickel oxide (NiO), and copper oxide (CuO), are introduced into a ball mill as raw materials, and subjected to wet mixing. The resultant mixture is dried and ground to obtain powder, which is pre-sintered at 800° C. for 1 hour. The resultant pre-sintered powder is subjected to wet grinding in the ball mill, and thereafter dried and cracked to obtain ferrite ceramic powder.

To the ferrite ceramic powder, a binder (vinyl acetate, water-soluble acrylic, or the like), a plasticizer, a wetting agent, and a dispersing agent are added and mixed in the ball mill, and thereafter defoamed under reduced pressure. The resultant ceramic slurry is spread over carrier sheets by a doctor blade method and dried to form ceramic green sheets from which to make insulator layers 16.

Next, via-hole conductors b1 to b6 are provided through their respective ceramic green sheets from which to make insulator layers 16*c* to 16*h*. Specifically, the ceramic green sheets from which to make insulator layers 16*c* to 16*h* are irradiated with laser beams to bore via holes therethrough. Moreover, a paste made of a conductive material such as Ag, Pd, Cu, Au, or an alloy thereof, is applied by printing or suchlike to fill the via holes, thereby forming the via-hole conductors b1 to b6.

Next, a paste made of a conductive material is applied by screen printing to the ceramic green sheets from which to make insulator layers 16*c*, 16*e*, 16*g*, and 16*i*, thereby forming coil conductors 18*a*, 18*c*, 18*e*, and 18*g*. More specifically, the paste made of a conductive material is applied to the insulator layers 16*c*, 16*e*, 16*g*, and 16*i* via the screen plate M1 (see FIG. 4A) with an opening OP1 having the same shape as the coil conductors 18*a*, 18*c*, 18*e*, and 18*g*. Note that the screen plate M1 of FIG. 4A is intended for forming the coil conductor 18*a*. The screen plate M1 has an opening provided in a cross section normal to the direction in which the coil conductor 18*a* extends. The paste made of a conductive material is, for example, Ag powder with varnish and a solvent added thereto.

Next, a paste made of a conductive material is applied by screen printing to the ceramic green sheets from which to form insulator layers 16*d*, 16*f*, and 16*h*, thereby forming coil conductors 18*b*, 18*d*, and 18*f*. More specifically, the paste made of a conductive material is applied to the insulator layers 16*d*, 16*f*, and 16*h* via the screen plate M2 (see FIG. 4B) with an opening OP2 having the same shape as the coil conductors 18*b*, 18*d*, and 18*f*. Note that the screen plate M2 of FIG. 4B is intended for forming the coil conductor 18*b*. The screen plate M2 has two openings OP3 and OP4 arranged in the width direction of the coil conductor 18*b* in a cross section normal to the direction in which the coil conductor 18*b* extends. Accordingly, the cross-sectional shape of each of the coil conductors 18*b*, 18*d*, and 18*f* immediately after formation is divided by two parts arranged in the width direction.

Note that forming the coil conductors 18 and filling the via holes with the paste made of a conductive material may be included in the same step.

Figure 3A:
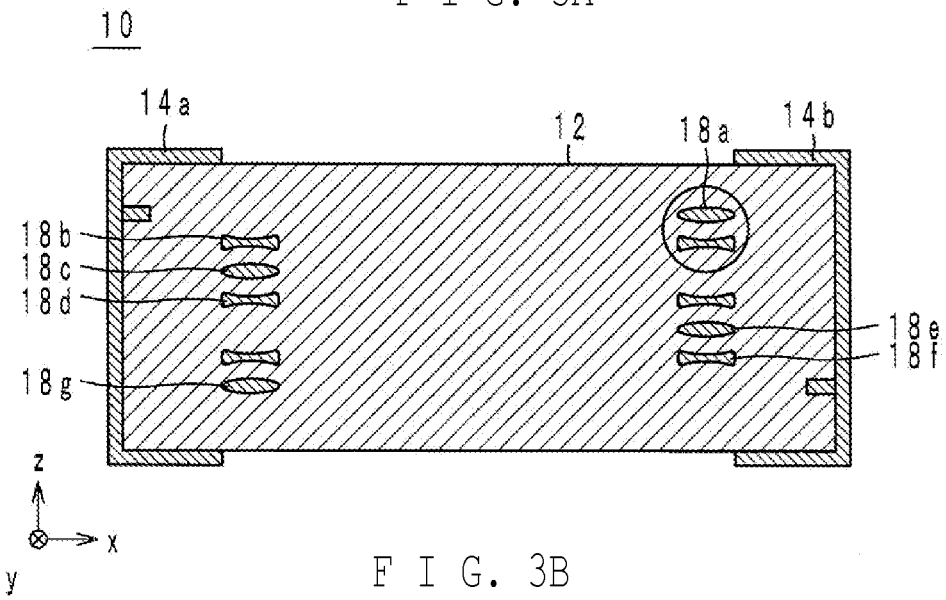
FIG. 3A is a cross-sectional structural view taken along line A-A of FIG. 1.
Figure 3B:
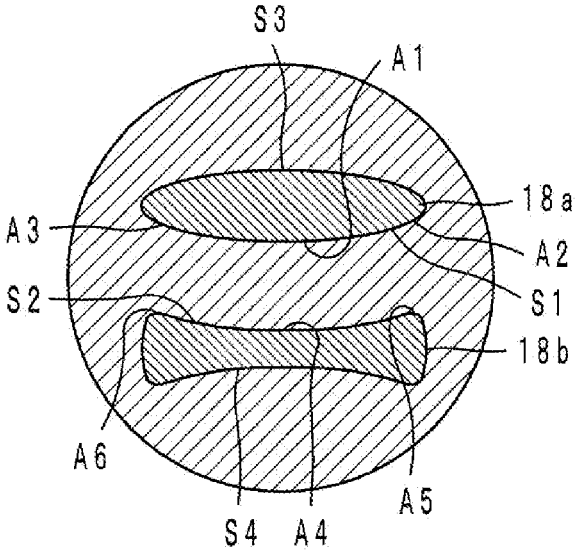
FIG. 3B is an enlarged view of the area encircled in FIG. 3A.

Next, the ceramic green sheets from which to make insulator layers 16 are laminated and pre-bonded one by one to obtain an unsintered laminate 12. Note that the ceramic green sheets from which to make insulator layers 16 are laminated such that, among the coil conductors 18*a* to 18*g*, each adjacent pair in the z-axis direction is opposed to each other. Thereafter, the unsintered laminate 12 is firmly bonded by isostatic pressing. The isostatic pressing conditions are a pressure of 100 MPa and a temperature of 45° C. In the prebonding and the firm bonding, the coil conductors 18*a*, 18*c*, 18*e*, and 18*g* are compressed in the z-axis direction, and deformed elliptically, as shown in FIG. 3A, which is a cross-sectional view of electronic component 10, and in FIG. 3B, which is an enlarged view of the circled area shown in FIG. 3A. On the other hand, the coil conductors 18*b*, 18*d*, and 18*f* are compressed in the z-axis direction so as to have their two-part divisions connected, and deformed so as to be concaved at the center in the width direction, as shown in FIG. 3B.

Next, the unsintered laminate 12 is subjected to debinding and sintering. The debinding is performed, for example, in a low-oxygen atmosphere at 850° C. for two hours. The sintering is performed, for example, at 900° C. to 930° C. for 2.5 hours. Thereafter, the front face of the laminate 12 is barreled for beveling.

Next, an electrode paste, which is made of a conductive material mainly composed of Ag, is applied to side surfaces of the laminate 12 at opposite ends in the x-axis direction. Then, the applied electrode paste is baked at a temperature of about 800° C. for one hour. As a result, silver electrodes to serve as external electrodes 14 are formed. Moreover, the silver electrodes to serve as external electrodes 14 are plated with Ni and Sn on their front surfaces, so that the external electrodes 14 are completed. By the foregoing process, the electronic component 10 is completed.

Figure 8:
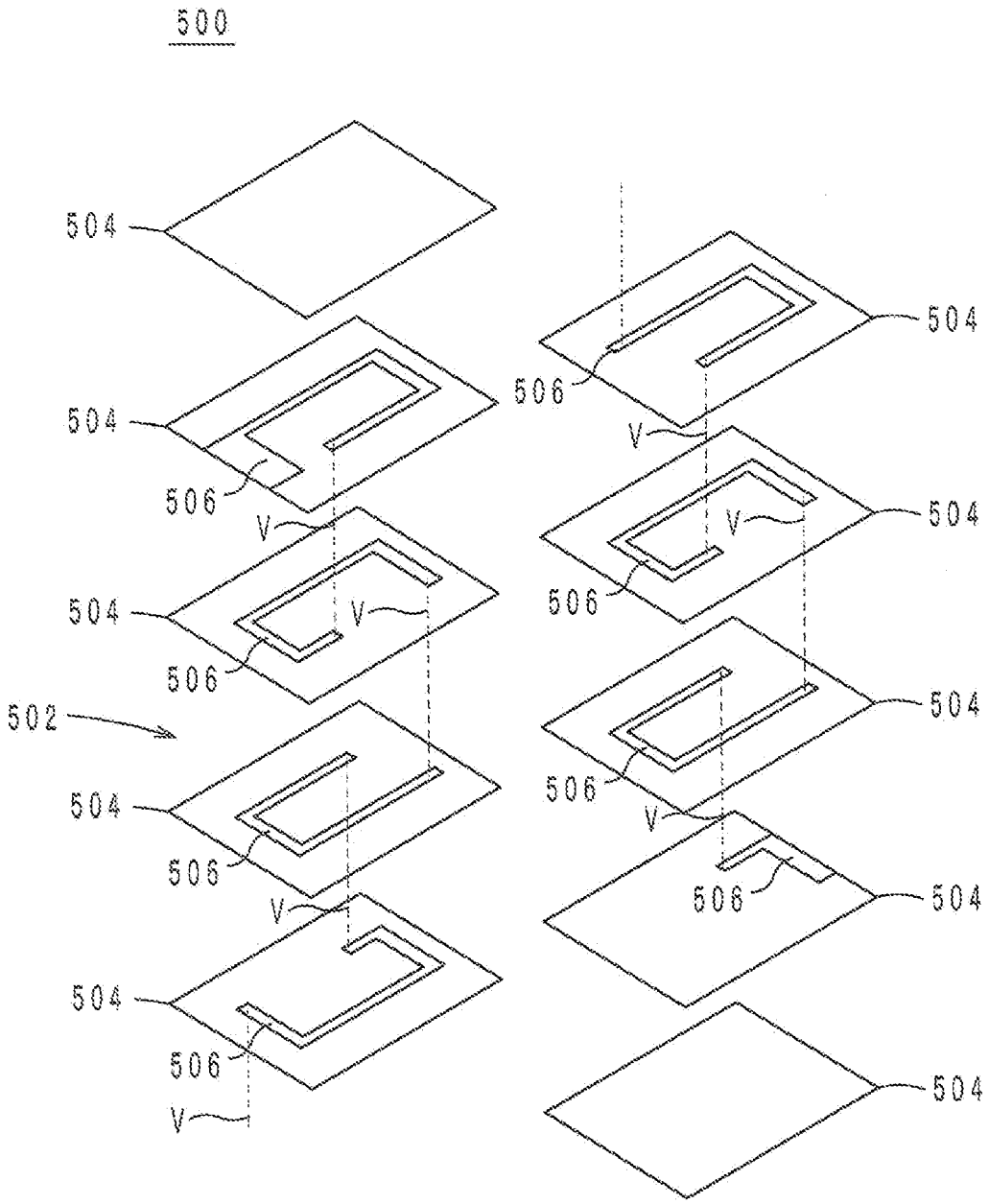
FIG. 8 PRIOR ART
FIG. 8 is a cross-sectional structural view of a laminate of a laminated electronic component described in Japanese Patent Laid-Open Publication No. 2001-176725.

Effects:

The electronic component 10 thus configured and the method for producing the same render it possible to inhibit occurrence of lamination misalignment among the coil conductors 18. More specifically, in the case of the laminate 500 described in, for example, Japanese Patent Laid-Open Publication No. 2001-176725, the coil-forming conductors 506 overlap one another in the direction of lamination, as shown in FIG. 8. Accordingly, in the laminate 500, the height of the area with the coil-forming conductor 506 in the direction of lamination is greater than the height of the area with no coil-forming conductor 506 in the direction of lamination. Therefore, when the laminate 500 is subjected to pressure-bonding, the applied force concentrates on the areas where the coil-forming conductors 506 are formed. As a result, the coil-forming conductors 506 might be misaligned in the direction perpendicular to the direction of lamination.

On the other hand, in the case of the electronic component 10, the shape of the side S2 conforms or is complementary to the shape of the side S1, as shown in FIG. 3B. More specifically, the side S1 has the convex portion A1 bulging toward the coil conductor 18*b* (i.e., toward the negative side in the z-axis direction) in a cross section normal to the direction in which the coil conductor 18*a* extends. The side S2 has the concave portion A4 recessed in the direction away from the coil conductor 18*a* (toward the negative side in the z-axis direction) in a cross section normal to the direction in which the coil conductor 18*b* extends. Moreover, the concave portion A4 overlaps the convex portion A1 in the z-axis direction. That is, the coil conductor 18*a* can be fitted in the coil conductor 18*b*. As a result, when force is applied to the coil conductors 18*a* and 18*b*, the coil conductors 18*a* and 18*b* are inhibited from being misaligned in the direction perpendicular to the z-axis direction. Thus, lamination misalignment among the coil conductors 18 in the electronic component 10 is inhibited.

Furthermore, in the method for producing the electronic component 10, the coil conductors 18*a*, 18*c*, 18*e*, and 18*g* are formed using the screen plate M1 provided with one opening in a cross section normal to the direction in which the coil conductor 18 extends. Therefore, the cross-sectional shape of each of the coil conductors 18*b*, 18*d*, and 18*f* immediately after formation is not divided into two parts arranged in the width direction. Moreover, the coil conductors 18*b*, 18*d*, and 18*f* are formed using the screen plate M2 provided with two openings OP3 and OP4 arranged in the width direction of the coil conductors 18 in a cross section normal to the direction in which the coil conductors 18 extend. Accordingly, the cross-sectional shape of each of the coil conductors 18*b*, 18*d*, and 18*f* immediately after formation is divided into two parts arranged in the width direction. In addition, the insulator layers 16 are laminated such that, among the coil conductors 18*a* to 18*g*, each adjacent pair in the z-axis direction is opposed to each other, and then firmly bonded by isostatic pressing. As a result, the coil conductors 18*a*, 18*c*, 18*e*, and 18*g* are compressed in the z-axis direction, and deformed elliptically, as shown in FIG. 3B. On the other hand, the coil conductors 18*b*, 18*d*, and 18*f* are compressed in the z-axis direction so as to have their two-part divisions connected, and deformed so as to be concaved at the center in the width direction, as shown in FIG. 3B. This renders the electronic component 10 resistant to lamination misalignment among the coil conductors 18, as described earlier.

Furthermore, the electronic component 10 inhibits pressure from concentrating at the center of the coil conductor 18*a* in the width direction, so that the coil conductor 18*a* is inhibited from significantly spreading in the width direction at the time of pressure bonding. Thus, it is possible to inhibit the coil L of the electronic component 10 from being reduced in inner diameter, and the area surrounding the coil L of the electronic component 10 from being narrowed.

Method for Producing Electronic Component According to Modification:

A method for producing an electronic component 10 according to a modification will be described below. In the method for producing an electronic component 10 according to the modification, two types of coil conductors different in shape from each other, i.e., the coil conductors 18*a*, 18*c*, 18*e*, and 18*g* and the coil conductors 18*b*, 18*d*, and 18*f*, are formed using two types of conductive paste, rather than using the screen plate M1 of FIG. 4A and the screen plate M2 of FIG. 4B.

More specifically, a first conductive paste in which Ag powder particles move relatively less readily and a second conductive paste in which Ag powder particles move relatively more readily are prepared. In an example of a method for allowing Ag powder particles to move more readily in the second conductive paste than in the first conductive paste, a solvent used in the second conductive paste is more readily dried compared to a solvent used in the first conductive paste. Moreover, the proportion of a resin component in the second conductive paste can be rendered lower than the proportion of a resin component in the first conductive paste. Yet further, the proportion of the solvent in the second conductive paste can be rendered higher than the proportion of the solvent in the first conductive paste. Still further, the proportion of the metal powder (Ag powder) in the second conductive paste can be rendered lower than the proportion of the metal powder in the first conductive paste.

Furthermore, the coil conductors 18*a*, 18*c*, 18*e*, and 18*g* are formed by screen printing on the insulator layers 16*c*, 16*e*, 16*g*, and 16*i*, respectively, using the first conductive paste. The screen plate used at this time is the screen plate M1 of FIG. 4A.

Furthermore, the coil conductors 18*b*, 18*d*, and 18*f* are formed by screen printing on the insulator layers 16*d*, 16*f*, and 16*h*, respectively, using the second conductive paste. The screen plate used at this time is the screen plate M1 of FIG. 4A.

In the case of the coil conductors thus formed, the amount of paste is less at opposite ends in the width direction than at the center in the width direction, and therefore, the coil conductors dry faster at the opposite ends in the width direction than at the center in the width direction. Accordingly, the solvent concentration of the coil conductors is lower at the opposite ends in the width direction than at the center in the width direction. Therefore, the solvent in the coil conductors spreads from the center in the width direction toward the opposite ends in the width direction so as to become uniform in concentration. At this time, the Ag powder particles in the coil conductors 18*b*, 18*d*, and 18*f* spread from the center in the width direction toward the opposite ends in the width direction as the solvent moves, because the coil conductors 18*b*, 18*d*, and 18*f* are made of the second conductive paste in which Ag powder particles move more readily. As a result, the coil conductors 18*b*, 18*d*, and 18*f* are shaped so as to be concaved at the center in the width direction.

Thus, the electronic component 10 can be obtained by the production method described above.

Figure 5:
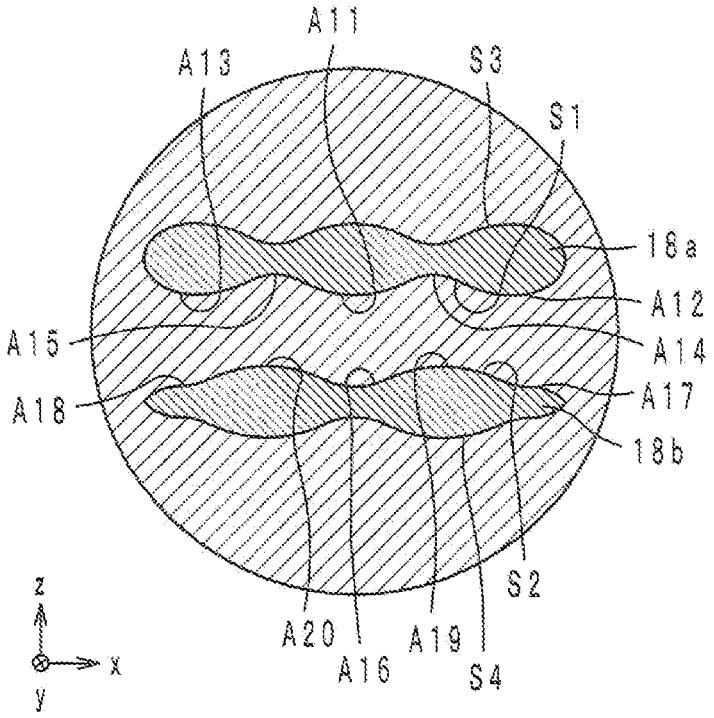
FIG. 5 is a cross-sectional structural view of coil conductors of an electronic component according to a first exemplary modification.

First Modification:

Hereinafter, an electronic component 10*a* according to a first modification will be described with reference to the drawings. FIG. 5 is a cross-sectional structural view of coil conductors 18*a* and 18*b* of the electronic component 10*a* according to the first modification.

The side S1 of the coil conductor 18*a* has convex portions A11 to A13 and concave portions A14 and A15. The convex and concave portions are arranged in order, from the positive side toward the negative side in the x-axis direction: convex portion A12, concave portion A14, convex portion A11, concave portion A15, and convex portion A13.

Furthermore, the side S2 of the coil conductor 18*b* has concave portions A16 to A18 and convex portions A19 and A20. The concave and convex portions are arranged in order, from the positive side toward the negative side in the x-axis direction: concave portion A17, convex portion A19, concave portion A16, convex portion A20, and concave portion A18. The concave portion A17, the convex portion A19, the concave portion A16, the convex portion A20, and the concave portion A18 overlap the convex portion A12, the concave portion A14, the convex portion A11, the concave portion A15, and the convex portion A13, respectively, in the z-axis direction. Thus, the side S2 has a shape conforming and complementary to the side S1. In this manner, the sides S1 and S2 can be provided with a plurality of concave portions and a plurality of convex portions.

In the electronic component 10*a* thus configured, as in the electronic component 10, lamination misalignment among the coil conductors 18 can be inhibited from occurring.

Figure 6:
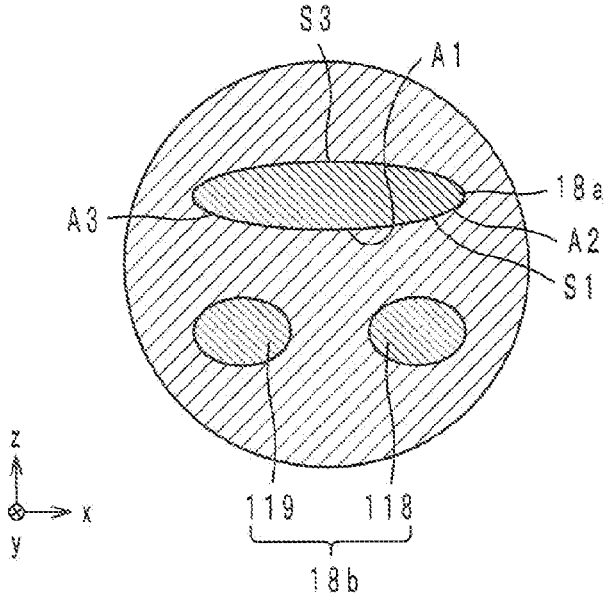
FIG. 6 is a cross-sectional structural view of coil conductors of an electronic component according to a second exemplary modification.

Second Modification:

Next, an electronic component 10*b* according to a second modification will be described with reference to the drawings. FIG. 6 is a cross-sectional structural view of coil conductors 18*a* and 18*b* of the electronic component 10*b* according to the second modification.

The coil conductor 18*a* of the electronic component 10*b* has the same shape as the coil conductor 18*a* of the electronic component 10, and therefore, any description thereof will be omitted.

The coil conductor 18*b* is divided into a plurality (two) of parts arranged in its width direction in a cross section normal to the direction in which the coil conductor 18*b* extends, but these parts do not overlap the convex portion A1 in the z-axis direction. More specifically, the coil conductor 18*b* is divided into conductive portions 118 and 119 arranged in this order from the positive side toward the negative side in the x-axis direction. The conductive portions 118 and 119 overlap the curving-down portions A2 and A3, respectively, in the z-axis direction. The convex portion A1 overlaps a gap between the conductive portions 118 and 119 in the z-axis direction.

In the electronic component 10*b* thus configured, as in the electronic component 10, lamination misalignment among the coil conductors 18 can be inhibited from occurring.

Figure 7:
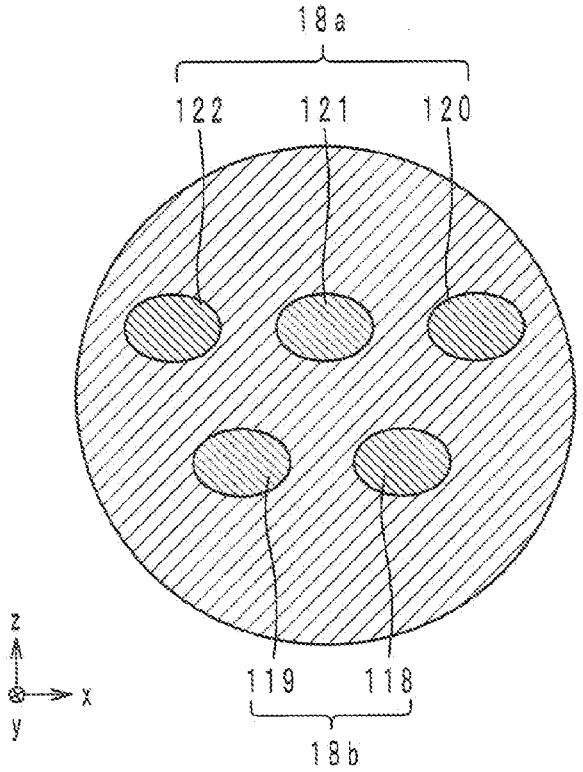
FIG. 7 is a cross-sectional structural view of coil conductors of an electronic component according to a third exemplary modification.

Third Modification:

Next, an electronic component 10*c* according to a third modification will be described with reference to the drawings. FIG. 7 is a cross-sectional structural view of coil conductors 18*a* and 18*b* of the electronic component 10*c* according to the third modification.

The coil conductor 18*b* of the electronic component 10*c* has the same shape as the coil conductor 18*b* of the electronic component 10*b*, and therefore, any description thereof will be omitted.

The coil conductors 18*a* and 18*b* are arranged in this order from the positive side toward the negative side in the z-axis direction.

The coil conductor 18*a* is divided into a plurality (three) of parts arranged in its width direction in a cross section normal to the direction in which the coil conductor 18*a* extends. More specifically, the coil conductor 18*a* is divided into conductive portions 120, 121, and 122 arranged in this order from the positive side toward the negative side in the x-axis direction.

The conductive portions 118 and 119 of the coil conductor 18*b* do not overlap the conductive portions 120, 121, and 122 of the coil conductor 18*a* in the z-axis direction. Specifically, the conductive portion 118 overlaps a gap between the conductive portions 120 and 121 in the z-axis direction, and the conductive portion 119 overlaps a gap between the conductive portions 121 and 122 in the z-axis direction.

In the electronic component 10*c* thus configured, as in the electronic component 10, lamination misalignment among the coil conductors 18 can be inhibited from occurring.

Other Embodiments:

The present disclosure is not limited to the electronic components 10 and 10*a* to 10*c* according to the above embodiments and their production methods.

The screen plate M1 is provided with an opening in a cross section normal to the direction in which the coil conductor 18*a* extends, as shown in FIG. 4A. Moreover, the screen plate M2 is provided with two openings OP3 and OP4 arranged in the width direction of the coil conductor 18*b* in a cross section normal to the direction in which the coil conductor 18*b* extends, as shown in FIG. 4B. However, the number of openings in the screen plates M1 and M2 is not limited to the above. For example, the screen plate M1 can be provided with a first number of openings in the cross section normal to the direction in which the coil conductor 18*a* extends, and the screen plate M2 can be provided with a second number of openings arranged in the width direction of the coil conductor

18*b* in the cross section normal to the direction in which the coil conductor 18*b* extends, so long as the difference between the first and second numbers is 1.

Although the present disclosure has been described in connection with the exemplary embodiment above, it is to be noted that various changes and modifications are possible to those who are skilled in the art. Such changes and modifications are to be understood as being within the scope of the disclosure.

What is claimed is:

1. An electronic component comprising:

a laminate formed by laminating a plurality of insulator layers; and a helical coil provided in the laminate and formed by a plurality of coil conductors provided on the insulator layers, the helical coil including first and second coil conductors, and via-hole conductors provided so as to pierce through the insulator layers, the first and second coil conductors being opposed to each other in a direction of lamination, the first coil conductor having a first side existing toward the direction of the lamination and a third side existing toward a direction opposite thereto and the first side and the third side having, in a cross section normal to a direction in which the first coil conductor extends, a first convex portion and a second convex portion, respectively, and the second coil conductor having a second side existing toward the direction opposite thereto and a fourth side existing toward the direction of the lamination and the second side and the fourth side having, in a cross section normal to a direction in which the second coil conductor extends, a first concave portion and a second concave portion, respectively, the first concave portion overlapping the first convex portion in the direction of lamination.

2. The electronic component according to claim 1, wherein the first and second coil conductors are arranged so as to alternate in the direction of lamination.

3. The electronic component according to claim 1, wherein the first concave portion and the first convex portion are complementary in shape.

4. The electronic component according to claim 3, wherein the first convex portion and the second convex portion of the first coil conductor are centrally located between the first concave portion of one of the second coil conductors and the second concave portion of another one of the second coil conductors.

5. The electronic component according to claim 3, wherein the first concave portion and the second concave portion of the second coil conductor are located between the first convex portion of one of the first coil conductors and the second convex portion of another one of the first coil conductors.

6. The electronic component according to claim 4, wherein the first convex portion has a shape of the second convex portion turned in the direction of lamination.

7. The electronic component according to claim 5, wherein the second concave portion has a shape of the first concave portion turned in the direction of lamination.

* * * * *